US009957784B1

(12) United States Patent
Boyd et al.

(10) Patent No.: US 9,957,784 B1
(45) Date of Patent: May 1, 2018

(54) LATCH FOR A BALL AND SLEEVE PLUNGER

(71) Applicant: Flowco Production Solutions, LLC, Spring, TX (US)

(72) Inventors: Garrett S. Boyd, Godley, TX (US); Mitchell A. Boyd, Haslet, TX (US)

(73) Assignee: Flowco Production Solutions, LLC, Spring, TX (US)

( * ) Notice: Subject to any disclaimer, the term of this patent is extended or adjusted under 35 U.S.C. 154(b) by 0 days. days.

(21) Appl. No.: 15/400,222

(22) Filed: Jan. 6, 2017

Related U.S. Application Data

(60) Provisional application No. 62/412,959, filed on Oct. 26, 2016.

(51) Int. Cl.

| | |
|---|---|
| ***E21B 43/12*** | (2006.01) |
| ***E21B 34/06*** | (2006.01) |
| ***E21B 34/14*** | (2006.01) |
| ***E21B 34/00*** | (2006.01) |

(52) U.S. Cl.
CPC ..... *E21B 43/122* (2013.01); *E21B 34/00* (2013.01); *E21B 34/06* (2013.01); *E21B 34/14* (2013.01); *E21B 2034/002* (2013.01); *E21B 2034/007* (2013.01)

(58) Field of Classification Search
CPC ..... E21B 34/14; E21B 34/06; E21B 34/00; E21B 2034/007
See application file for complete search history.

(56) References Cited

U.S. PATENT DOCUMENTS

| | | | | |
|---|---|---|---|---|
| 5,417,291 | A | 5/1995 | Leising | |
| 7,383,878 | B1 * | 6/2008 | Victor | E21B 43/121 166/105 |
| 2004/0017049 | A1 * | 1/2004 | Fink | F16J 15/004 277/627 |
| 2005/0241819 | A1 | 11/2005 | Victor | |
| 2007/0124919 | A1 * | 6/2007 | Probst | B29D 11/00413 29/700 |
| 2012/0305236 | A1 * | 12/2012 | Gouthaman | E21B 33/1285 166/118 |
| 2013/0133876 | A1 * | 5/2013 | Naedler | E21B 43/16 166/101 |
| 2014/0116714 | A1 | 5/2014 | Jefferies et al. | |

(Continued)

OTHER PUBLICATIONS

HPAlloys; Monel K500; product brochure (webpages); 4 pages; undated.

(Continued)

*Primary Examiner* — David J Bagnell
*Assistant Examiner* — Tara E Schimpf
(74) *Attorney, Agent, or Firm* — Whitaker Chalk Swindle & Schwartz PLLC; Stephen Mosher

(57) ABSTRACT

An improved latch structure for a two piece ball and sleeve bypass plunger comprises a single retaining ring installed in a groove formed in the inside diameter of the sleeve portion of the bypass plunger. The cross section profiles of the groove and the associated retaining ring are smaller in the radial direction. The depth of the groove in the sleeve is substantially reduced to provide increased wall thickness and robustness of the sleeve along the diameter of the sleeve, thereby extending the useful life of the bypass plunger.

14 Claims, 6 Drawing Sheets

(56) References Cited

U.S. PATENT DOCUMENTS

| | | | | |
|---|---|---|---|---|
| 2015/0167428 | A1* | 6/2015 | Hofman | E21B 34/16 166/373 |
| 2016/0061012 | A1 | 3/2016 | Zimmerman, Jr. | |
| 2016/0238002 | A1 | 8/2016 | Williams et al. | |
| 2017/0058651 | A1 | 3/2017 | Damiano et al. | |
| 2017/0268318 | A1* | 9/2017 | Roycroft | E21B 43/121 |

OTHER PUBLICATIONS

Smalley Steel Ring Company; Constant Section Rings (Snap Rings); product brochure (website); 3 pages; printed Aug. 23, 2017; www.smalley.com/retaining-rings/contant-section-rings.

* cited by examiner

LATCH FOR A BALL AND SLEEVE PLUNGER

CROSS REFERENCE TO RELATED APPLICATIONS

The present U.S. Patent Application claims priority to U.S. Provisional Patent Application Ser. No. 62/412,959 filed Oct. 26, 2016 by the same inventors and entitled IMPROVED LATCH FOR A BALL AND SLEEVE PLUNGER, incorporated herein by reference. The present Application is also related to U.S. patent application Ser. No. 15/048,408 filed Feb. 19, 2016 and entitled UNIBODY BYPASS PLUNGER WITH CENTRALIZED HELIX AND CRIMPLE FEATURE, and also related to U.S. patent application Ser. No. 15/048,467 filed Feb. 19, 2016 and entitled IMPROVED CLUTCH ASSEMBLY FOR BYPASS PLUNGERS, and also related to U.S. patent application Ser. No. 15/048,491 filed Feb. 19, 2016 and entitled IMPROVED DART VALVES FOR BYPASS PLUNGERS, filed concurrently herewith the same inventors.

BACKGROUND OF THE INVENTION

1. Field of the Invention

The present invention generally relates to bypass plungers for lifting fluids from an oil or gas well that has insufficient pressure to sustain production, and more particularly to an improved latch for a two-piece ball and sleeve bypass plunger.

2. Background of the Invention and Description of the Prior Art

Two piece ball and sleeve bypass plungers are simple devices well-known in the art. The hollow sleeve includes a spherical seat in its lower end formed to match the spherical surface of the ball, thereby forming a ball check valve when the ball is seated against the seat in the sleeve. In use, the ball portion is dropped into a well first, followed by the sleeve portion. Both portions free fall toward the bottom of the well. When the sleeve contacts the ball at the well bottom, the ball is retained in the sleeve portion by a latching mechanism disposed in the sleeve, thereby holding the ball check valve closed. When the pressure of the gas in the formation is sufficient to lift the plunger, the plunger ascends toward the surface. There, a lubricator structure dislodges the ball portion from its latch and releases it to fall downward into the well, followed soon thereafter by the sleeve.

Ball and sleeve plungers are typically equipped with a latch that retains the ball against its seat during ascent of the plunger in the well tubing. The ascent is often not smooth, but subject to substantial jarring impacts that may cause the ball to become unseated if it is not latched in position against its seat. Further, in situations where the plunger is exposed to pressure differentials that may be sufficient to dislodge the ball from its seat, a latch resists such forces so that the plunger may continue to operate properly as it ascends. It should be apparent that a latch of some kind is an essential feature of a ball and sleeve plunger.

As a point of reference in this discussion and the description that follows, it is understood that the axis of a retaining ring passes through the center of the ring and is normal to the diameter of the ring. Thus, an "axial" dimension is parallel to the axis of the retaining ring and a "radial" dimension is oriented along a diameter of the retaining ring.

In a conventional design the latching mechanism in a ball and sleeve plunger typically includes a pair of standard retaining rings—aka "snap rings"—disposed side-by side in a single deep groove cut into the inside wall of the seat of the sleeve portion of the plunger. The standard rings are formed as thin rings wherein the body of the ring has a rectangular cross section whose long dimension (in the radial direction) is greater than its short dimension (thickness of the ring) that is parallel to the axis of the ring. This form requires that the groove depth extend substantially through the wall thickness of the sleeve, reducing the wall thickness by approximately 50%. This arrangement weakens the wall of the sleeve, making the sleeve susceptible to premature failure—i.e., well before the sleeve itself is worn out from many cycles of use—when it encounters the high impact force as it contacts the bumper at the end of its descent.

What is needed is a latching system that does not weaken the wall of the sleeve portion of a ball and sleeve bypass plunger to extend the useful life of the plunger.

SUMMARY OF THE INVENTION

Accordingly there is provided a latch mechanism for a two piece ball and sleeve bypass plunger for retaining the ball in the lower end of the sleeve during ascent of the plunger. The latch mechanism comprises a single retaining ring installed in a groove formed in the inside diameter of the sleeve portion of the bypass plunger, wherein the cross section profile of the groove is defined by a first aspect ratio $R_1$ such that its radial dimension $A_1$ is less than its axial dimension $B_1$; and the cross section profile of the retaining ring is defined by a second aspect ratio $R_2$ such that its radial dimension $A_2$ is less than its axial dimension $B_2$.

In one aspect the latch mechanism is defined by the relationships $R_1=(A_1/B_1)<1$ for the groove and $R_2=(A_2/B_2)<1$ for the retaining ring.

In other aspects, the latch mechanism is characterized by a groove formed in the inside diameter of the sleeve portion that extends less than or equal to ⅓ the wall thickness of the sleeve; wherein the overall diameter of the groove formed in the inside diameter of the sleeve is less than 0.050" greater than the outside diameter of the circular retaining ring; and wherein the retaining ring includes a gap to allow for expansion and contraction thereof as the ball portion of the bypass plunger is received by the latch mechanism at the end of its descent into a well and dislodged at the end of its ascent to the surface.

In other aspects, the retaining ring may be formed to a circular perimeter or a circular wave perimeter, wherein the perimeter defines a periodic wave profile around the circumference of the ring. For example, a periodic wave profile includes at least three uniformly-spaced maximum radii interspersed by uniformly-spaced minimum radii of the retaining ring.

In yet another aspect of the invention, the sleeve may include an access hole formed radially through the wall of the sleeve in alignment with the bottom of the groove to permit insertion of a punch for removing the retaining ring. Alternatively, the sleeve may include a small relief cut-out formed in the inside wall of the sleeve at a right angle to and extending into the bottom of the groove. Such a groove may permit insertion of a prying tool under the retaining ring to facilitate removal of the retaining ring.

DETAILED DESCRIPTION OF THE INVENTION

In an advance in the state of the art, an improved latching mechanism is described herein that extends the useful life of a two-piece ball and sleeve bypass plunger. The latching mechanism includes a single split retaining ring installed in a groove formed in the inside diameter of the sleeve portion of the bypass plunger. When the ball component is not in the plunger, the quiescent inside diameter of the retaining ring is slightly less than the diameter of the ball component. The groove is positioned relative to the spherical valve seat so the when the ball component of the valve is seated against the valve seat, the largest diameter portion of the ball is disposed just past the retaining ring, which expands slightly to allow the ball to pass through the ring and seat against the spherical valve seat. This is because the inside diameter of the retaining ring must be slightly smaller than the diameter of the ball to act as an effective latch mechanism. The cross section profile of the groove formed into the inside bore of the sleeve is generally defined by a first aspect ratio $R_g$ such that its radial dimension $A_g$ is less than its axial dimension $B_g$; and the cross section profile of the retaining ring is defined by a second aspect ratio $R_r$ such that its radial dimension $A_r$ is less than its axial dimension $B_r$. The aspect ratios can also be defined by the relationships: $R_g=(A_g/B_g)<1$ and $R_r=(A_r/B_r)<1$.

The use of a single retaining ring that is thin in the radial direction and broader in the axial direction, may be called a "flat ring"—but not "flat" in the sense of a flat washer—that has several advantages. (1) Such a "flat" retaining ring permits the groove machined into the inside wall of the sleeve to be limited to no more than ⅓ the thickness of the wall, which increases the wall thickness at the location of the groove by approximately 33%. This increased wall thickness provides a corresponding increase in durability. (2) Further, the flat ring is more flexible in the radial direction, which makes it easier to install and to withstand a wider range of impacts without breaking during use, while still functioning effectively to latch the ball valve against its seat.

Figure 2:
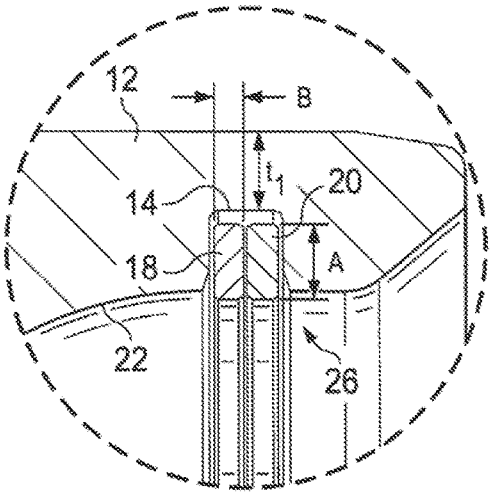
FIG. 2 (PRIOR ART)
FIG. 2 illustrates an enlarged cross section view of the latch portion of the prior art plunger of FIG. 1 that uses two rings.
Figure 5:
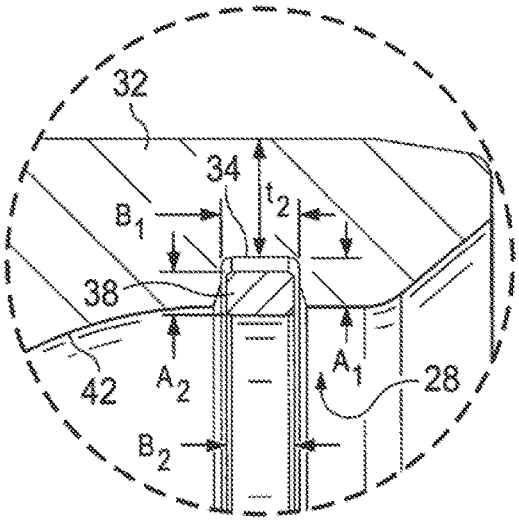
FIG. 5 illustrates an enlarged cross section view of the latch portion of the embodiment of FIG. 4 that uses a single retaining ring.

Reference is made to FIGS. 2 and 5, drawn to the same scale, which graphically illustrate the structural differences between the prior art latch 26 (FIG. 2) and the improved latching mechanism 28 (FIG. 5) of the present invention. Both figures, which depict a portion of the wall of the lower end of the sleeve in cross section, are drawn to the same scale for a typical ball and sleeve bypass plunger. FIG. 2 shows a prior art latch 26—an assembly of a pair of thin (axially) retaining rings 18, 20 (also known as "snap rings" in the industry) disposed side by side in a groove 14 that extends approximately half-way through the wall thickness of the sleeve 12. The aspect ratio of each ring 18, 20, is defined by the relationship R=A/B, which is greater than 1 (R>1) and the remaining wall thickness is $t_1$. Standard snap rings tend to have insufficient flexibility in the radial direction because they have an aspect ratio that is not well-suited for use in the latch mechanism of a ball and sleeve plunger. Two rings are required instead of one to overcome the tendency for a ring to break under severe impacts of the ball as it collides with the sleeve. Another drawback of using ordinary "snap rings" is that it is more difficult to machine a very narrow groove into the inner bore of the sleeve that is deep enough to receive the relatively large radial dimension of the snap ring.

In contrast, FIG. 5 shows one example of a flat ring—a single thin (radially) split retaining ring 38 disposed in a much shallower groove 34, resulting in a thicker sleeve wall having a thickness dimension $t_2$ at the location of the groove, thus providing a more robust sleeve 32. The aspect ratios of the latching mechanism 28 formed by the ring 38 and the groove 34 are respectively defined by $R_1=A_1/B_1$ and $R_2=A_2/B_2$, where $R_1<1$ and $R_2<1$. Thus, the remaining wall thickness of the sleeve 32 is $t_2$, where $t_2>t_1$. From the scale drawing of FIG. 5 $t_2$ is seen to be approximately ⅓ greater than $t_1$, that is, $t_2\approx 4/3\ t_1$. The improvement, clearly depicted by comparing the scale drawings in FIGS. 2 and 5, is a substantial increase in strength. This advantage has been verified by failure analysis data under conditions that simulate the impact forces encountered at the well bottom.

The foregoing description assumed that the split retaining ring 38 having an aspect ratio R<1 has a circular perimeter or outline. An alternate embodiment, to be described below in FIGS. 7, 8A and 8B, may be characterized as a "circular wave ring." That is, it is generally circular, but has an outline that is wave-like around the perimeter such that the radius of the retaining ring 44 at regular intervals is greater than the radius at intervals midway between the location of the greater radii. Thus, there may be three to nine evenly distributed "peaks" in the radii around the perimeter of the retaining ring 44. One advantage of the "wave ring" is that, because of its shape, it is easier to remove from the sleeve if necessary without modification to the sleeve.

In the detailed following description the appearance in more than one figure of a reference number identifying a structural feature refers to the same feature.

Figure 1:
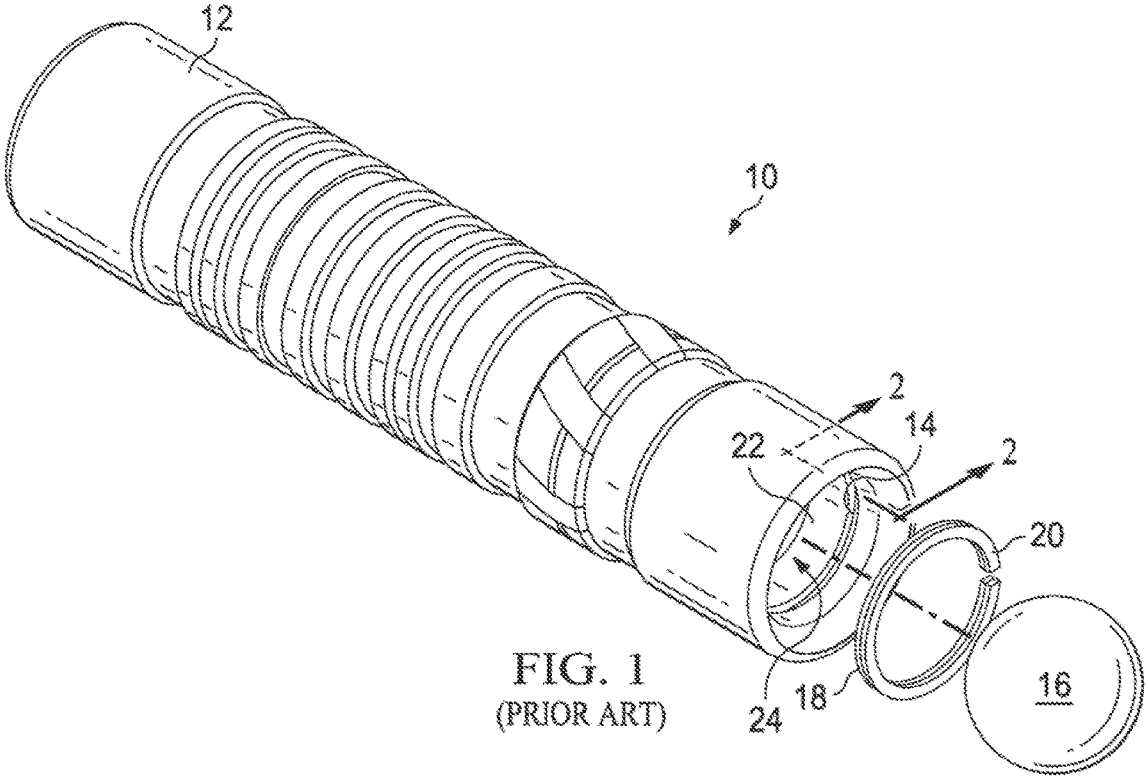
FIG. 1 (PRIOR ART)
FIG. 1 illustrates an isometric view of a prior art ball and sleeve bypass plunger that uses a two-ring latch.

FIG. 1 illustrates an isometric view of a prior art ball and sleeve bypass plunger 10 that uses a conventional two-ring latch. The sleeve 12 includes a groove 14 formed within the lower end of the sleeve within the surface of a seat 22 for a ball valve 16 when it is latched by first 18 and second 20 retaining rings. The retaining rings 18, 20 are disposed side-by-side in the groove 14 to function as a latch. Thus, as the plunger sleeve 12 reaches the bottom of a well and contacts the ball valve 16, the momentum of the sleeve 12 causes the ball valve 16 to exert force on the retaining rings 18, 20, forcing them to expand their diameter slightly to admit the ball valve 16 past the retaining rings 18, 20 to contact the seat 22 in the sleeve 12. When retained by the latch against the seat 22, the ball valve 16 seals the internal passage 24 of the sleeve 12 from the passage of fluid. In this prior art example, the two retaining rings 18, 20 are typically identical. The cross section of the rings 18, 20 and the cross section of the groove 14 are both characterized by an aspect ratio R>1; that is, the radial dimension of the ring body (and the groove) exceeds the axial dimension of the ring body. This configuration provides retaining rings 18, 20 that, while able to expand and contract diametrically in the manner of a split retaining ring, the range of expansion and contraction is limited because of the relatively stiff spring constant of retaining rings having an aspect ratio R>1.

FIG. 2 illustrates an enlarged cross section view of the latch portion of the prior art plunger of FIG. 1 that uses two retaining rings 18, 20 disposed in a groove 14 formed within the lower end of a plunger sleeve 12. FIG. 2 shows that the depth of the groove necessary to accommodate the retaining rings having a radial dimension A1 that is relatively large and extends approximately half-way or 50% through the wall thickness of the sleeve 12, leaving an uncut wall thickness of $t_1$. The extent of this incursion into the wall of the sleeve 12 weakens it substantially, making it susceptible to breaking at or near the groove 14 upon repeated impacts against the ball 16 at the well bottom. Even cracks in the sleeve wall near the groove that result from such impacts can impair the functioning of the latch mechanism and the plunger assembly.

Figure 3:
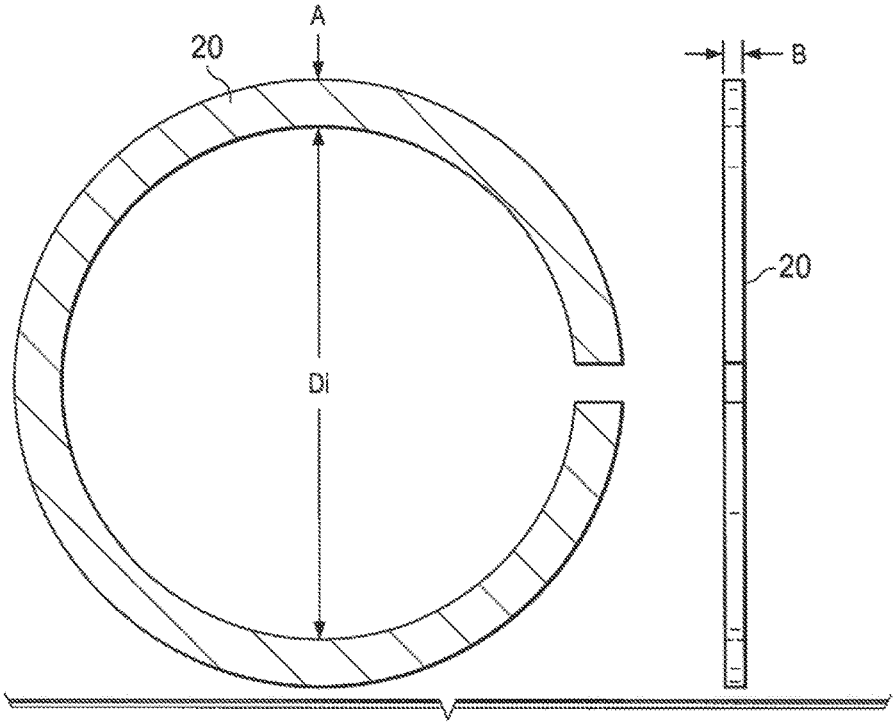
FIG. 3 (PRIOR ART)
FIG. 3 illustrates an axial cross section view and an edge-wise view of a prior art retaining ring as used in the prior art plunger depicted in FIGS. 1 and 2.

FIG. 3 illustrates an axial cross section view and an edge-wise view of a prior art retaining ring 20 (or 18, which is identical) as used in the prior art plunger 10 depicted in FIGS. 1 and 2. The internal diameter is identified as Di, the radial dimension as A, and the axial dimension as B. It is apparent in this view that the aspect ratio R=A/B of the retaining ring cross section is greater than 1.

Figure 4:
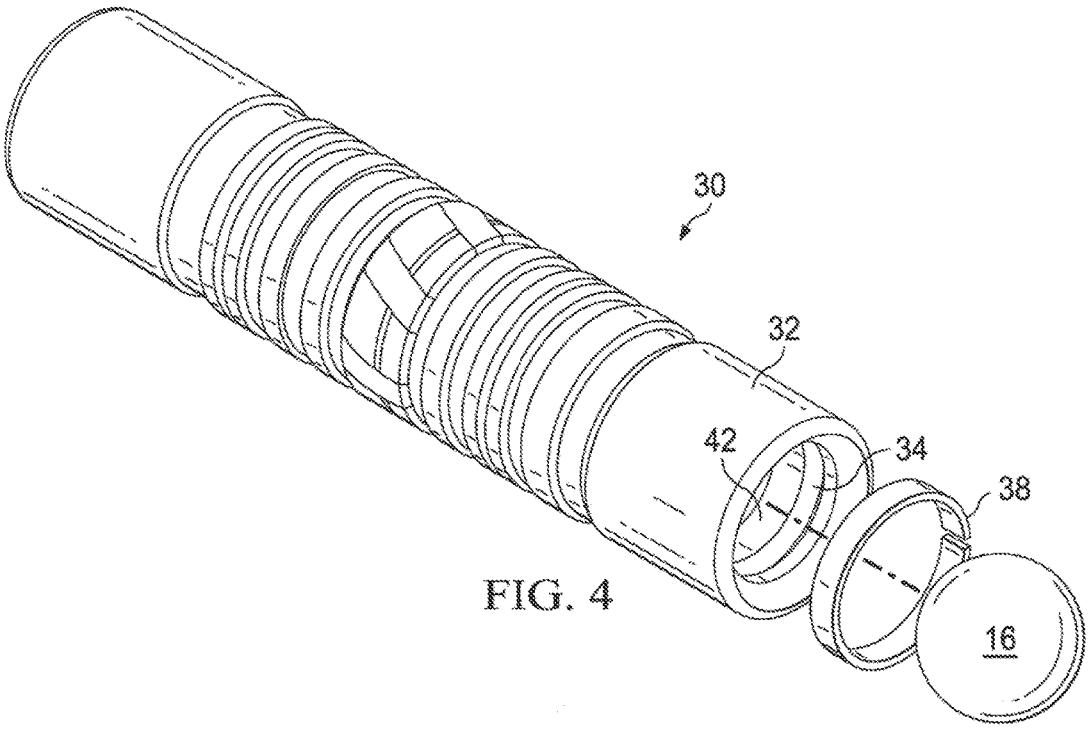
FIG. 4 illustrates one embodiment of a ball and sleeve bypass plunger that uses a single retaining ring according to the present invention.
Figure 12:
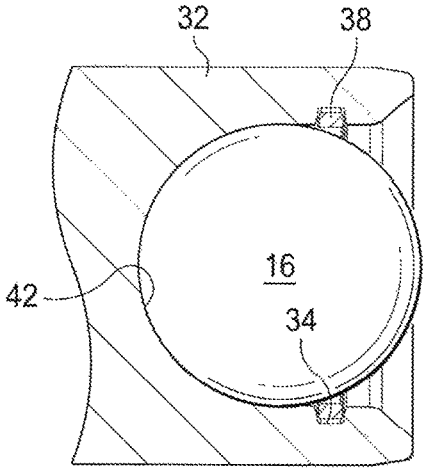
FIG. 12 illustrates a cross section view of the latch portion of the embodiment of FIGS. 4 and 5 holding a ball valve against its seat.

FIGS. 4 and 12 illustrate one embodiment of a ball and sleeve bypass plunger that uses a latch mechanism according to the present invention that modifies both the retaining ring and the groove in which it is installed. The sleeve 32 includes a groove 34 formed within the lower end of the sleeve 32 proximate the surface of a spherical seat 42 (near its largest diameter). The spherical seat 42 is shaped to receive a spherical valve 16 of the same or slightly smaller diameter when the sphere or ball 16 is held against the seat 42—i.e., latched by the single retaining ring 38 disposed in the groove 34. Thus, as the plunger sleeve 32 reaches the bottom of a well and contacts the ball 16, the momentum of the sleeve 32 causes the ball 16 to exert force on the retaining ring 38 to cause it to expand its diameter sufficiently to admit the ball 16 past the retaining ring 38 to contact the seat 42 in the sleeve 32. When retained by the latch against the seat 42, the ball 16 seals the internal passage 46 of the sleeve 32 from the passage of fluid to enable the plunger to ascend through the well when sufficient differential pressure exists.

The cross section of the retaining ring 38 and the groove 34 are both characterized by an aspect ratio R<1; that is, the radial dimension of the ring body (and the depth of the groove) is less than the axial dimension of the retaining ring body (and the width of the groove). This configuration provides a retaining ring 38 that has a greater range of expansion and contraction because of the lower spring constant of a retaining ring having an aspect ratio R<1. The retaining ring 38 includes a gap in its perimeter to allow for expansion and contraction thereof as the ball portion of the bypass plunger is received by the latch mechanism at the end of its descent into a well. In order to accommodate this expansion of the retaining ring 38, the overall—i.e., outermost—diameter of the groove 34 formed in the inside diameter of the sleeve may typically be less than 0.050" greater than the outside diameter of the retaining ring 38. In various applications the clearance may vary from 0.001" to more than 0.050" as long as the diameter of the groove is not so large that the retaining ring 38 cannot firmly hold the ball 16 in a latched position or the groove cannot hold the retaining ring in position or prevent damage to the retaining ring from clearances that are excessive. Thus, this clearance may vary with the particular dimensions and tension required in a particular application, and will be approximately the same value as the difference between the diameter of the ball component of the plunger assembly and the inside diameter of the retaining ring 38. In general, the inside diameter of the retaining ring must be slightly smaller than the diameter of the ball to act as an effective latch mechanism.

FIG. 5 illustrates an enlarged cross section view of the latching mechanism 28 of the embodiment of FIG. 4 that uses a single retaining ring disposed in a groove 34 formed within the lower end of a plunger sleeve 32. FIG. 5 shows that the depth of the groove necessary to accommodate the retaining ring 38 having a radial dimension $A_2$ that is relatively small. The retaining ring 38 thus extends much less than half-way—no more than 33%—through the wall thickness of the sleeve 32, leaving an uncut wall thickness of $t_2$. The extent of this reduced incursion into the wall of the sleeve 32 strengthens it substantially, making it much less susceptible to breaking at or near the groove 34 upon repeated impacts against the ball 16 at the well bottom.

Figure 6:
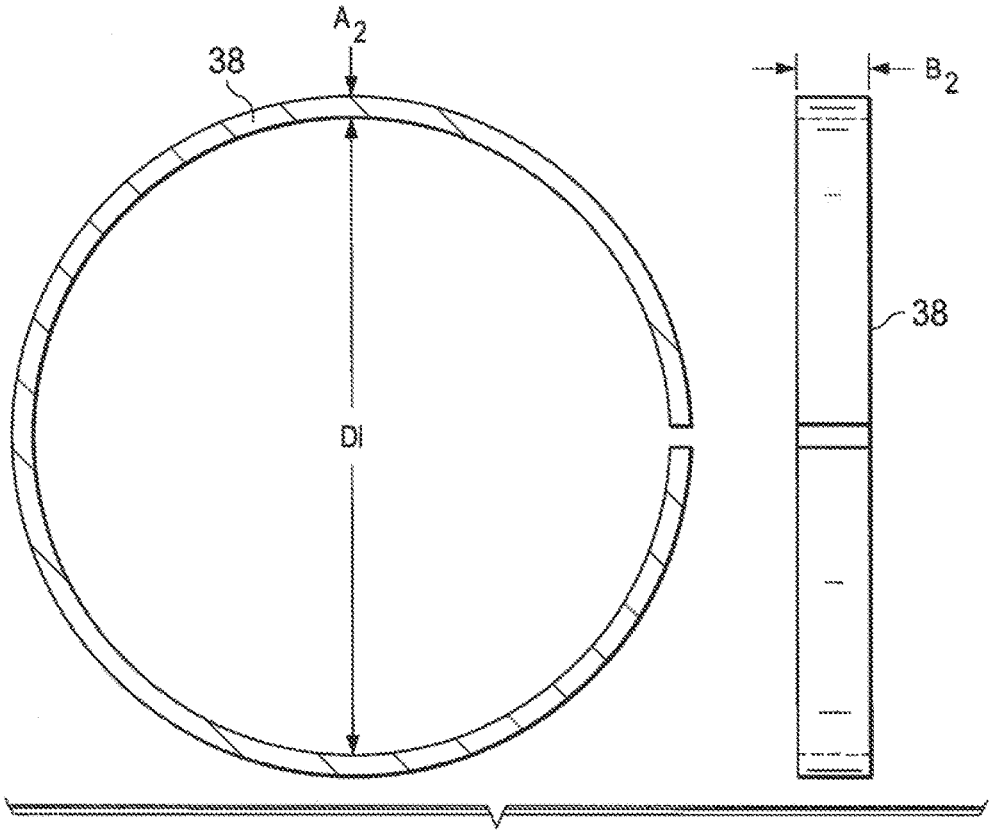
FIG. 6 illustrates an axial cross section view and an edge-wise view of a retaining ring according to the present invention as used in the embodiment of FIG. 4.

FIG. 6 illustrates an axial cross section view and an edge-wise view of a retaining ring 38 according to the present invention as used in the embodiment of FIG. 4. The internal diameter is identified as Di, the radial dimension as $A_2$, and the axial dimension as B2. It is apparent in FIG. 6 that the aspect ratio $R_2=A_2/B_2$ of the retaining ring 38 cross section is less than 1 or, $R_2<1$.

Figure 7:
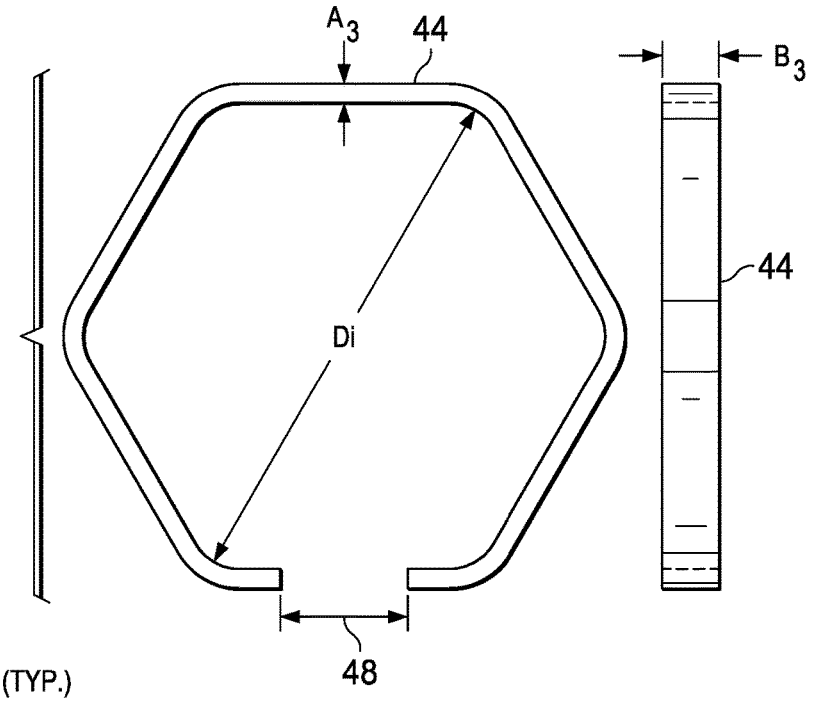
FIG. 7 illustrates an axial cross section view and an edge-wise view of an alternate embodiment of a retaining ring according to the present invention as may be used in the embodiment of FIG. 4.

FIG. 7 illustrates an axial cross section view and an edge-wise view of an alternate embodiment of a retaining ring 44 according to the present invention as may be used interchangeably in the embodiment of FIG. 4. This alternate embodiment, also depicted in FIGS. 8A and 8B, may be characterized as a "circular wave ring." That is, it is generally circular and has a gap 48 at one position around its circumference, but has an outline formed as a circular wave perimeter that is wave-like around the perimeter such that the radius of the retaining ring 44 at regular intervals ("maxima") is greater than the radius at intervals ("minima") midway between the location of the greater radii. Thus, there may be three to nine maxima 46 or "peaks" in the radii distributed—usually evenly—around the perimeter of the retaining ring 44. However, in practice, the number of maxima will generally be three to six because increasing the number of maxima rapidly increases the tension exerted by the wave ring. For example, increasing the number of maxima 46 increases the tension embodied in the wave ring while decreasing the number of maxima 46 reduces the tension embodied in the wave ring. The retaining ring 44 shown in FIG. 7 is hexagonal, that is, it has six maxima 46. One advantage of the "wave ring" is that it is easier to remove from the sleeve if necessary without modification to the sleeve. Thus, the circular wave ring provides an alternate way to adjust the tension provided by the retaining ring 44 other than varying the thickness (radial dimension) of the retaining ring. Persons skilled in the art will recognize that the dimensions and shape of the circular wave ring are subject to empirical determination for particular intended applications to arrive at a suitable configuration.

Figure 8A:
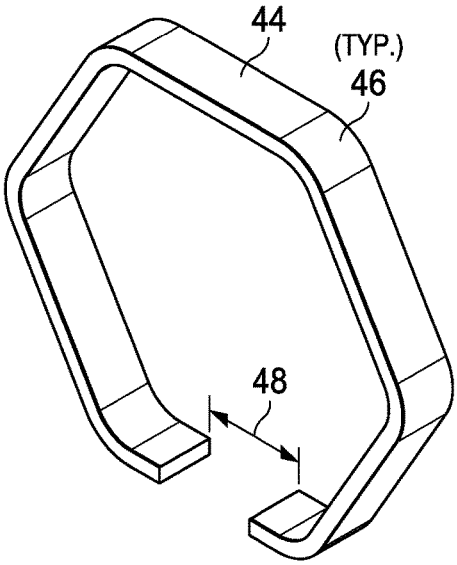
FIG. 8A illustrates an isometric view of the retaining ring depicted in FIG. 7.
Figure 8B:
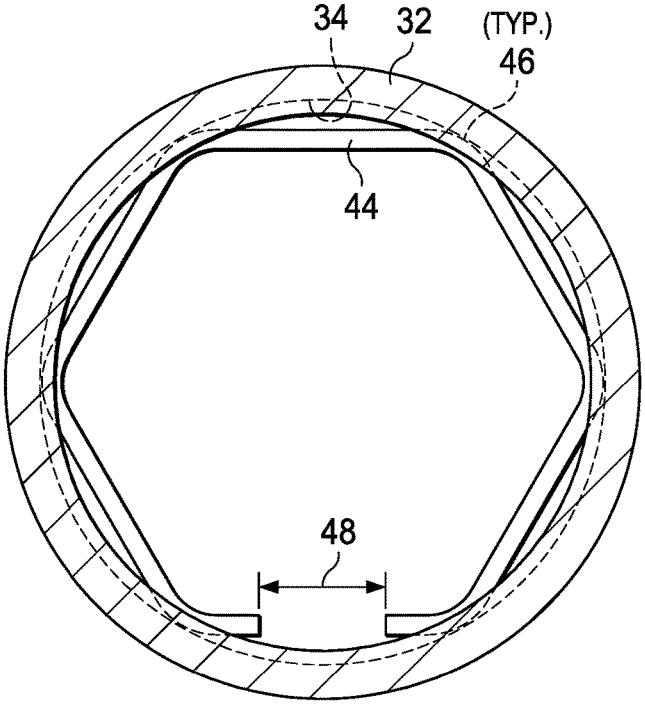
FIG. 8B illustrates a cross section view of the retaining ring embodiment shown in FIG. 8A installed in a corresponding groove disposed in the inside diameter of the sleeve portion of the ball and sleeve plunger depicted in FIG. 4.

FIG. 8A illustrates an isometric view of the retaining ring 44 and its six peaks 46 around the perimeter as depicted in FIG. 7. FIG. 8B illustrates a cross section view of the retaining ring 44 of FIG. 8A installed in a corresponding groove 34 disposed in the inside diameter of the sleeve 32 of the ball and sleeve plunger depicted in FIG. 4. When a sleeve component of a plunger is designed for use with a wave ring, the diameter of the groove (i.e, corresponding to its 'depth') need be no greater than the outside diameter of the wave ring maxima because the passage of the ball past the wave ring does not need to expand the ring radially but expand its circumference (in the direction of reducing the ring gap 48) when the maxima move slightly apart within the groove as the ball passes. While the view of FIG. 8B shows the maxima 46 of the retaining ring 44 touching the inside (bottom) part of the channel 34, this condition occurs when the ball component is latched within the sleeve 32. The ball component is not shown in this view for clarity of the relationship of the retaining ring 44 and the sleeve 32.

It is an important feature of the single, flexible retaining ring of the novel latch mechanism described herein that it is more easily replaced than the rigid, double-ring combination taught by the prior art. Further, the sleeve, because of the shallower latch mechanism groove, is more robust than the prior art version. Thus both the replaceability of the retaining ring and the robustness of the sleeve enables extension of the useful life of the sleeve portion of the plunger.

Figure 9A:
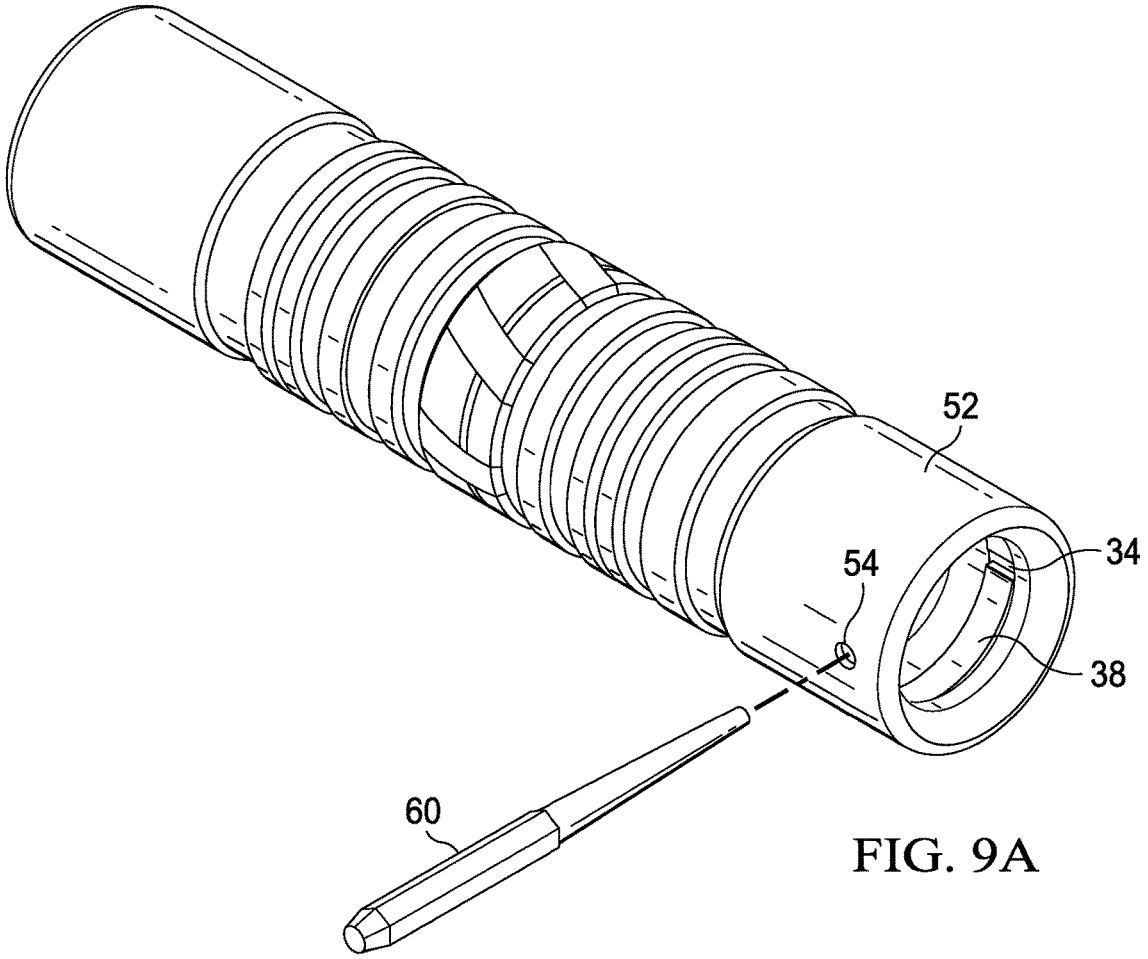
FIG. 9A provides an isometric view of a first example of a feature of the sleeve portion of a bypass plunger with a first tool for removing a retaining ring.
Figure 9B:
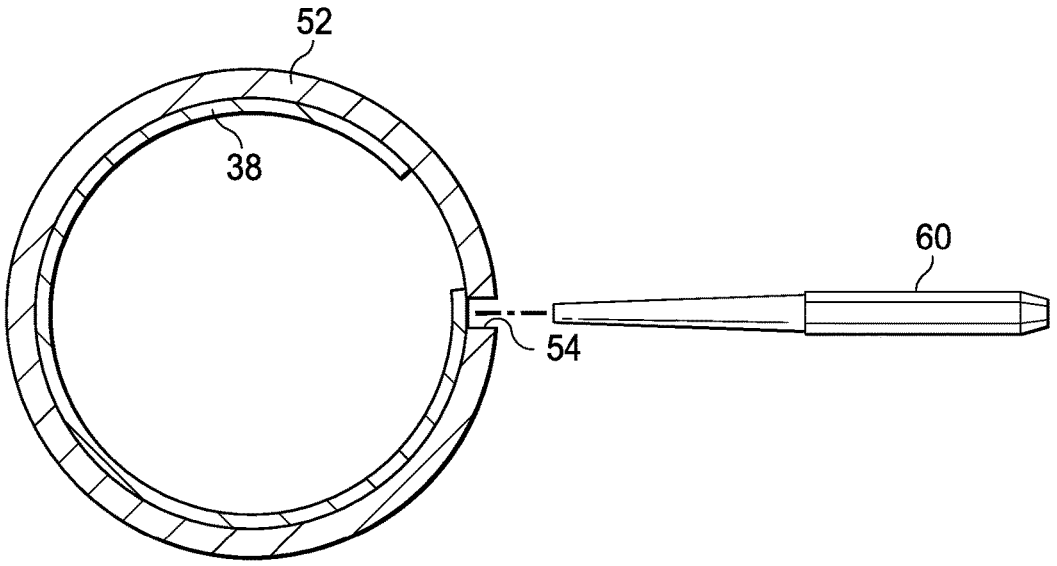
FIG. 9B illustrates a cross section of the sleeve portion of the bypass plunger and the first tool aligned with the feature depicted in FIG. 9A for removing a single retaining ring.
Figure 10:
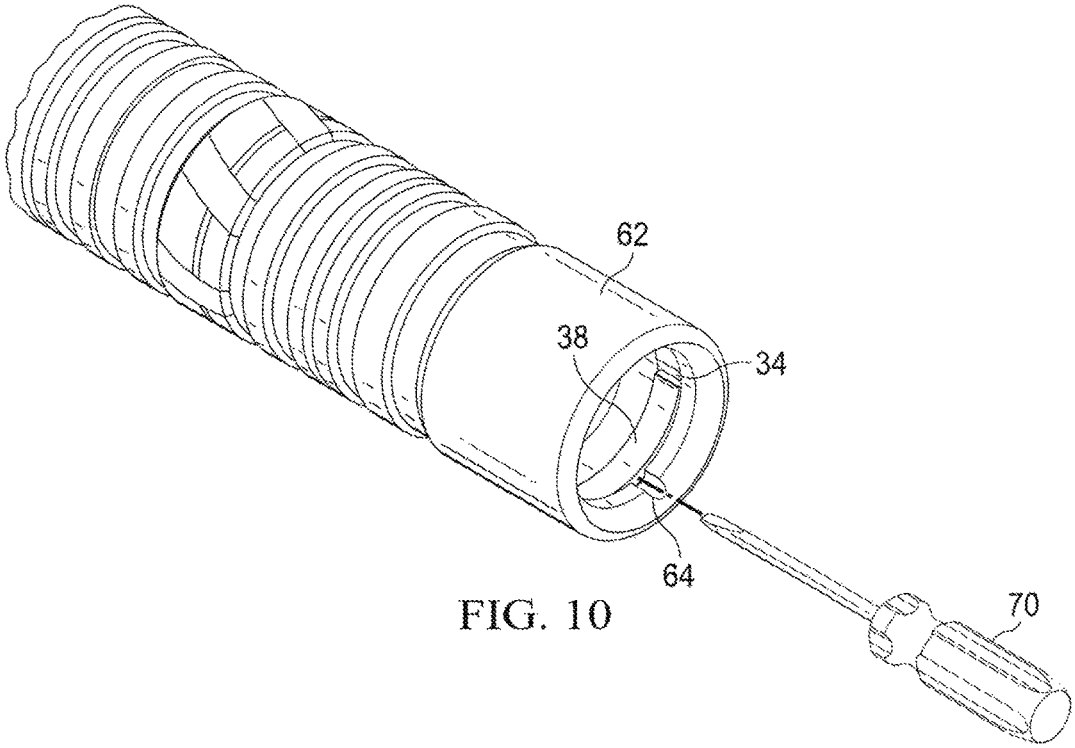
FIG. 10 illustrates an isometric view of a second example of a feature of the sleeve portion of a bypass plunger with a second tool for removing a retaining ring.

FIGS. 9A and 9B depict isometric and cross section views respectively of one modification to the sleeve 52 of a plunger to facilitate removal of a retaining ring 38 when it must be replaced during service. A punch or drift pin 60 may be inserted through small hole 54 through the wall of the sleeve 52 into the bottom of the groove 34 to urge the retaining ring 38 away from the bottom of the groove 34, to permit grasping the retaining ring 38 for removal. FIG. 10 depicts an isometric view of an alternate modification of the sleeve 62 to facilitate removal of a retaining ring 38. A prying tool 70 such as a screwdriver may be inserted into a small cut-out 64 machined into the proximate edge of the groove 34 as shown to lift the retaining ring 38 away from the groove 34, to permit grasping the retaining ring 38 for removal. The cut-out 64 cross section may be U-shaped or rectangular.

Figure 11:
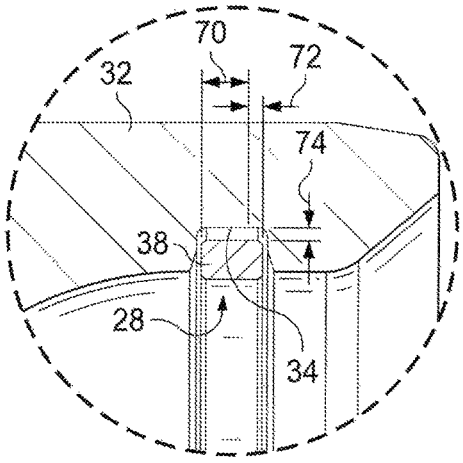
FIG. 11 illustrates an enlarged cross section view of the latch portion of the embodiment of FIGS. 4 and 5 (that uses a single retaining ring) to describe several additional dimensions of this embodiment.

FIG. 11 illustrates an enlarged cross section view of the latch portion of the embodiment of FIGS. 4 and 5 (that uses a single retaining ring) to describe several additional dimensions of importance in this embodiment. As before, the sleeve 32 includes a groove 34 for receiving a retaining ring 38, thereby forming a latching mechanism 28 in the sleeve 32. It will be noted that the sum of the dimensions 76 and 72 is equal to the dimension B2 in FIG. 5, which is the width or axial dimension of the retaining ring 38. The dimension 70 (which may preferably=¾ of the width of the retaining ring 38) defines the permissible locus of the axis of the ball 16 when it is seated against the seat 42 (see FIG. 4). In other words the groove 34 and the retaining ring 38 are positioned relative to the seat 42 so that the retaining ring 38 is displaced just beyond a distance equal to the radius of the ball when the ball 16 is seated. This relationship ensures that the ball 16 will be held in a closed position by the latch mechanism 28. The dimension 72 (which may preferably=¼ of the width of the retaining ring 38) defines a limit of the permitted position of the axis of the ball 16. In other words, the range of positions of the axis of the ball 16 is limited to all but the last ¼ of the width of the retaining ring 38.

Continuing with FIG. 11, the dimension 74 defines the clearance provided between the outer diameter of the retaining ring 38 and the outer-most or overall diameter of the groove 34 for circular retaining rings 38 as illustrated in FIGS. 4 and 6. This clearance may vary substantially depending upon the particular application. In general it can be any value from 0.001" upward, as long as it is small enough to prevent the retaining ring from being easily dislodged when the ball 16 is not in its seat 42. In practice this dimension 74 will generally be in the range of 0.001 to 0.050 inch but is not limited to that range. For alternate embodiments that use retaining rings having a wave profile as illustrated in FIGS. 7, 8A and 8B, the dimension 74 will generally be zero or very small because the peak portions of the retaining ring will slide circumferentially in the groove 34 while varying the gap 48 in the ring to accommodate the ball 16 as it passes the retaining ring 38.

The retaining ring 38 as described herein may preferably be fabricated of stainless steel. Other suitable metals or even synthetic materials are possible as long as they permit construction of a retaining ring that is flexible and capable of supplying the appropriate spring constant, can tolerate substantial impact forces, is resistant to elevated temperatures, toxic and caustic substances, etc. The flexibility is an important property that affects both function and durability of the latch mechanism in use. Other considerations of the latch mechanism to note are (a) The spring constant, which is a function of the material, the particular process used in its manufacture (such as cold working), the inside diameter Di, and the dimensions $A_2$ and $B_2$; (b) the inside diameter of the groove needs to be slightly larger than the outside diameter of the retaining ring to avoid binding of the ring within the groove or locking the ball to its seat; (c) the $B_2$ dimension must be thick enough so that it remains in the groove; and (d) the inside diameter Di of the retaining ring should be approximately 0.050" smaller than the diameter of the ball.

While the invention has been shown in only one of its forms, it is not thus limited but is susceptible to various changes and modifications without departing from the spirit thereof.

What is claimed is:

1. In a two piece bypass plunger comprising a ball and sleeve, a latch mechanism disposed within the bypass plunger for retaining the ball against a seat in a lower end of the sleeve, comprising:

a single retaining ring installed in a groove proximate the seat and formed in the inside diameter of the lower end of the sleeve of the bypass plunger for retaining the ball against the seat; wherein the cross section profile of the groove is rectangular and defined by a first aspect ratio $R_1$ such that its radial dimension $A_1$ is less than ⅔ of its axial dimension $B_1$; and the cross section profile of the retaining ring is rectangular and defined by a second aspect ratio $R_2$ such that its radial dimension $A_2$ is less than ⅔ of its axial dimension $B_2$.

2. The latch mechanism as defined in claim 1, wherein:

the groove formed in the inside diameter of the sleeve portion extends less than or equal to ⅓ the wall thickness of the sleeve.

3. The latch mechanism as defined in claim 1, comprising:

the overall diameter of the groove formed in the inside diameter of the sleeve is less than 0.050" greater than the outside diameter of the circular retaining ring.

4. The latch mechanism as defined in claim 1, wherein:

the retaining ring includes a gap in its perimeter to allow for expansion and contraction of the ring diameter as the ball portion of the bypass plunger is received by the latch mechanism at the end of its descent into a well.

5. The latch mechanism as defined in claim 1, wherein:

the retaining ring is formed to a circular perimeter.

6. The latch mechanism as defined in claim 1, wherein:

the retaining ring is formed to a circular wave perimeter, wherein the perimeter defines a periodic wave profile around the circumference of the ring.

7. The latch mechanism as defined in claim 6, wherein:

the periodic wave profile includes at least three uniformly-spared maxima of maximum radii interspersed by uniformly-spaced minima of minimum radii of the retaining ring.

8. The latch mechanism as defined in claim 1, wherein:

the sleeve includes an access opening formed radially through the wall of the sleeve in alignment with the groove to permit insertion of a punch for removing the retaining ring.

9. The latch mechanism as defined in claim 1, wherein:

the sleeve includes a relief formed in the inside wall of the sleeve at a right angle to and extending into the bottom of the groove to permit insertion of a prying tool under the retaining ring to facilitate removal of the retaining ring.

10. In a ball and sleeve bypass plunger, the sleeve formed as a hollow cylindrical member having a first inside diameter and first and second open ends, a check valve apparatus, comprising:

a spherical seat formed to a first radius inside the first open end of the sleeve, wherein the center of the first radius of the spherical seat is disposed on a longitudinal axis of the sleeve and proximate the first open end;

a groove formed around the first inside diameter of the sleeve proximate a plane passing through the center of radius of the spherical seat and normal to the longitudinal axis of the sleeve, wherein the groove is rectangular in cross section and its radial dimension A1 is less than ⅔ of its axial dimension B1;

a spherical valve formed having a second radius and disposed within the sleeve and against the spherical seat; and a circular retaining ring having a gap in its perimeter and a rectangular cross section, wherein the radial dimension A2 of the retaining ring is less than ⅔ of the axial dimension B2 of the retaining ring; and wherein the circular retaining ring is disposed within the groove formed around the inside of the sleeve for latching the spherical valve against the spherical seat.

11. The check valve apparatus of claim 10, wherein:

the groove is disposed between the plane passing through the center of radius of the spherical seat and the first open end of the sleeve.

12. The check valve apparatus of claim 10, wherein:

the spherical valve forms the ball portion of the ball and sleeve bypass plunger; and the second radius of the spherical valve is less than or equal to the first radius of the spherical seat.

13. The check valve apparatus of claim 10, wherein:

the sleeve includes a wall having a thickness defined between the first inside diameter and an outside diameter of the sleeve; and the radial dimension A1 of the groove disposed in the first inside diameter of the sleeve extends through less than ⅓ of the thickness of the wall of the sleeve.

14. The check valve apparatus of claim 10, wherein:

the sleeve includes a relief formed in the first inside wall of the sleeve at a right angle to and extending into the bottom of the groove to permit insertion of a prying tool under the retaining ring to facilitate removal of the retaining ring.

* * * * *